US005536111A

United States Patent [19]

Doernemann

[11] Patent Number: 5,536,111

[45] Date of Patent: Jul. 16, 1996

[54] ADJUSTABLE EROSION CONTROL WALL

[76] Inventor: Jarett Doernemann, Rte. 1, Box 172A, Clarkson, Nebr. 68629

[21] Appl. No.: 313,722

[22] Filed: Sep. 27, 1994

[51] Int. Cl.[6] ..... E02B 3/04; E02B 3/14

[52] U.S. Cl. ..... 405/16; 405/21; 405/33; 52/570; 52/590.1

[58] Field of Search ..... 405/21, 16, 15, 405/20, 33, 114; 52/604, 605, 607, 570, 596, 590.1; 404/40, 41

[56] References Cited

U.S. PATENT DOCUMENTS

| | | | |
|---|---|---|---|
| 1,332,655 | 3/1920 | Willard | 405/16 |
| 2,683,968 | 7/1954 | Budd | 405/33 |
| 2,942,115 | 6/1960 | O'Connell | 52/604 X |
| 3,347,048 | 10/1967 | Brown et al. | 405/16 |
| 3,373,668 | 3/1968 | Moore et al. | 404/41 |
| 3,375,667 | 4/1968 | Hard | 405/16 |
| 3,559,338 | 2/1971 | Klingberg | 47/33 |
| 3,951,294 | 4/1976 | Wilson | 220/5 R |
| 4,219,941 | 9/1980 | Hair | 34/93 |
| 4,318,642 | 3/1982 | Barnett | 405/284 |
| 4,436,447 | 3/1984 | Crowe | 405/16 |
| 4,503,649 | 3/1985 | Sciortino | 405/16 X |
| 4,650,368 | 3/1987 | Bayer | 405/11 |
| 4,798,498 | 1/1989 | Hallberg | 405/258 |
| 4,875,803 | 10/1989 | Scales | 405/16 |
| 4,978,247 | 12/1990 | Lenson | 405/15 |
| 5,035,532 | 7/1991 | Gargollo | 404/41 |

FOREIGN PATENT DOCUMENTS

| | | | |
|---|---|---|---|
| 2681621 | 3/1993 | France | 405/21 |

*Primary Examiner*—Stephen J. Novosad
*Attorney, Agent, or Firm*—Zarley, McKee, Thomte, Voorhees & Sease; Mark D. Frederiksen

[57] ABSTRACT

An adjustable erosion control wall includes a plurality of individual panels, each panel having a tongue projecting from one end and a groove formed in the opposing end. The panels of the retaining wall are pivotally and vertically slidably connected with the tongue of one panel engaged within the groove of an adjacent panel. Preferably, the tongue and groove have a generally cylindrical shape, and the panels have perforations therethrough of a diameter to permit water to flow therethrough but prevent the passage of soil therethrough.

10 Claims, 2 Drawing Sheets

ADJUSTABLE EROSION CONTROL WALL

TECHNICAL FIELD

The present invention relates generally to retaining walls, and more particularly to an improved erosion control wall composed of a plurality of adjustably connected panels.

BACKGROUND OF THE INVENTION

Retaining walls are well known in the prior art for retaining soil against the eroding force of water. Typically, such retaining walls were constructed of concrete slabs or elongated timbers connected together to form a single integral unit retaining soil behind one surface of the wall.

One of the major problems with prior art erosion control walls is in the weight of the components of the wall, and the associated difficulty in constructing the wall. The construction of a retaining wall typically required numerous workers and often heavy equipment to move and place the components in the appropriate position.

In addition, conventional retaining walls are difficult to construct to follow the contours of steeply sloping and rolling land. In addition, since the concrete slabs and timbers would not permit the flow of water therethrough, erosion around the slabs and timbers would often occur after each rain, thereby weakening the wall at the point of erosion.

SUMMARY OF THE INVENTION

It is therefore a general object of the present invention to provide an improved retaining wall formed of a plurality of adjustably connected panels.

Another object is to provide a retaining wall which prevents soil erosion, but permits the flow of water therethrough.

Still another object is to provide a retaining wall formed of a plurality of interconnected panels having pivotal and vertical adjustability at each panel connection.

Yet another object of the present invention is to provide an adjustable retaining wall formed of light weight panels which permit ease of transport and construction.

These and other objects will be apparent to those skilled in the art.

The adjustable erosion control wall of the present invention includes a plurality of individual panels, each panel having a tongue projecting from one end and a groove formed in the opposing end. The panels of the retaining wall are pivotally and vertically slidably connected with the tongue of one panel engaged within the groove of an adjacent panel. Preferably, the tongue and groove have a generally cylindrical shape, and the panels have perforations therethrough of a diameter to permit water to flow therethrough but prevent the passage of soil therethrough.

DESCRIPTION OF THE PREFERRED EMBODIMENT

Figure 4:
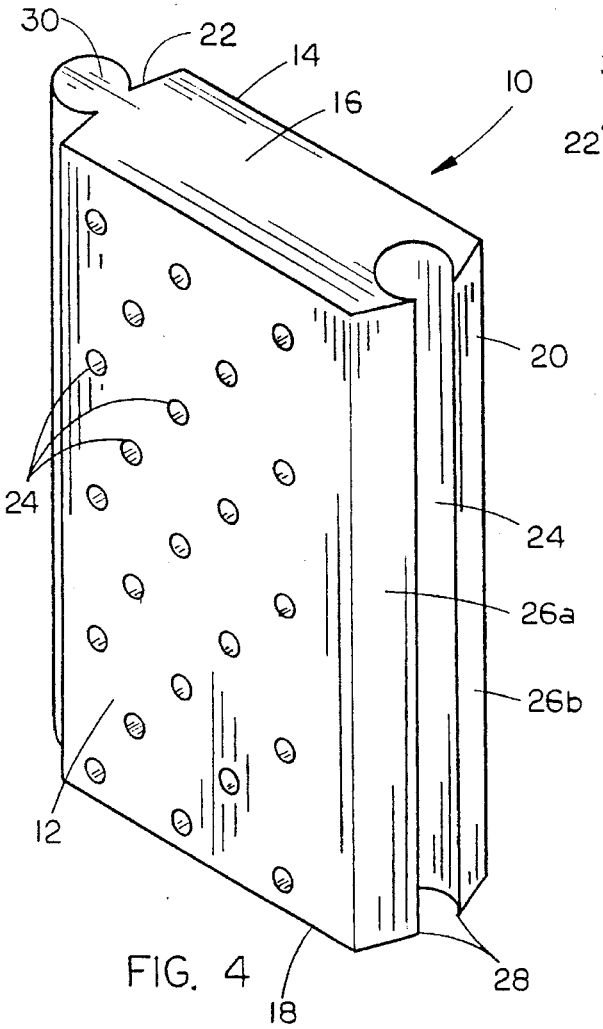
FIG. 4 is a perspective view of one panel of the retaining wall of the present invention.

Referring now to the drawings, in which similar or corresponding parts are identified with the same reference numeral, and more particularly to FIG. 4, one panel of the erosion control wall of the present invention is designated generally at 10 and is formed from a block having a forward face 12, rearward face 14, top 16, bottom 18, and opposing ends 20 and 22.

Figure 1:
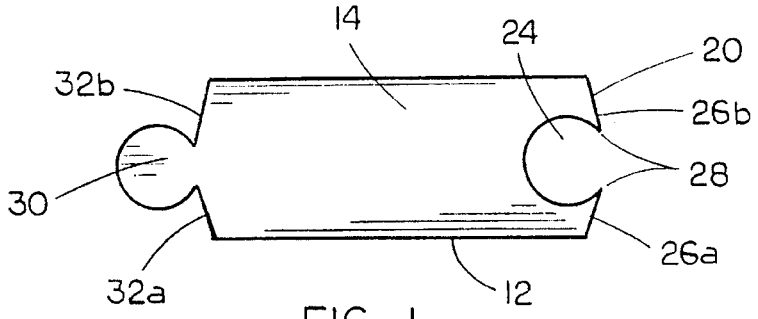
FIG. 1 is a top plan view of one panel of the retaining wall of the present invention.
Figure 2:
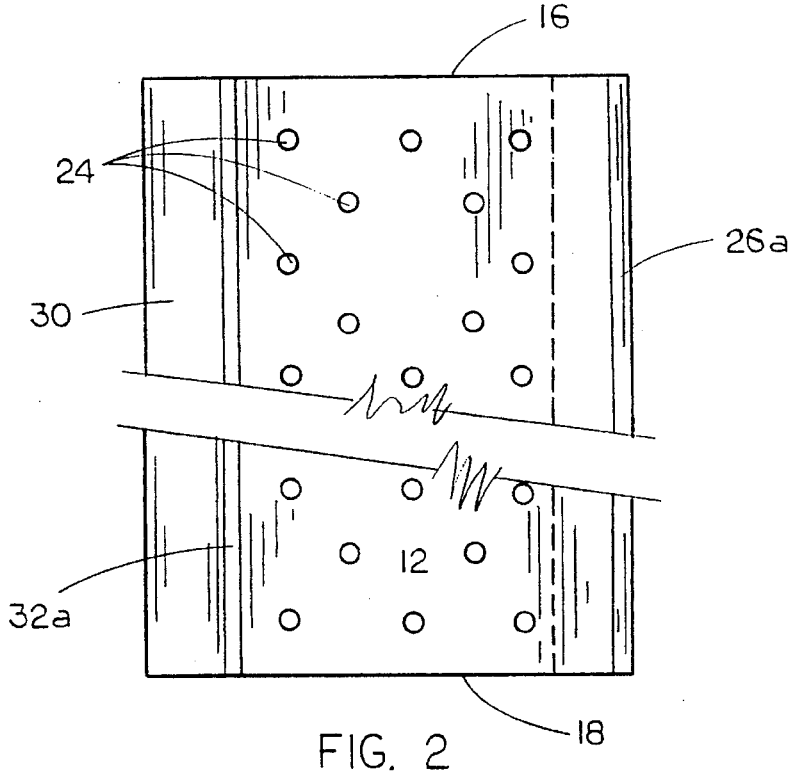
FIG. 2 is a front elevational view of the retaining wall panel of FIG. 1.

A plurality of perforations 24 extend from forward face 12 to rearward face 14 and have a diameter permitting the flow of water therethrough, but preventing the passage of soil. A generally cylindrical shaped groove 24 is formed along the entire height of first end 20, and has a vertically oriented longitudinal axis. As shown in FIG. 1, groove 24 separates first end wall 20 into two vertical shoulders **26*a* and 26*b* separated by groove 24. The diameter of groove 24 is greater than the throat 28, formed by the parallel adjacent edges of shoulders 26*a* and 26*b*. Shoulders 26*a* and 26*b* are not coplanar, but rather are beveled towards the forward and rearward faces 12 and 14** respectively.

Figure 3:
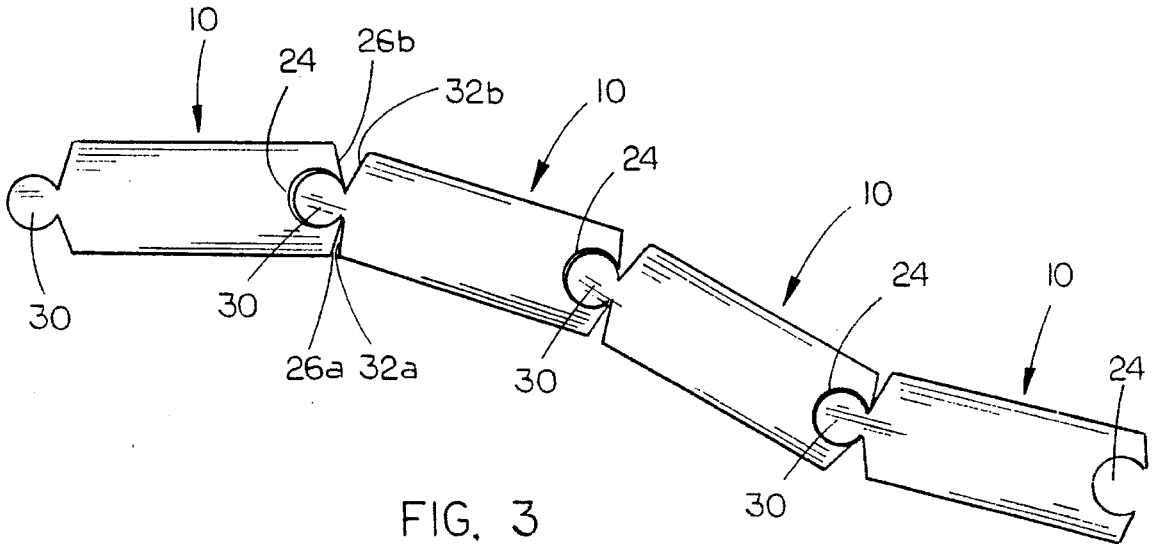
FIG. 3 is a top plan view of a plurality of panels interconnected to form a retaining wall.

A generally cylindrical tongue 30 extends along the entire height of second end wall 22 and is generally centrally located thereon, with a vertically oriented longitudinal axis. As shown in FIG. 1, tongue 30 divides second end wall 22 into a pair of opposing vertical shoulders **32*a* and 32*b*, with tongue 30 projecting outwardly therefrom. Shoulders 32*a* and 32*b* are also beveled, in a direction opposite to shoulders 26*a* and 26*b*, towards forward and rearward faces 12 and 14, respectively. Cylindrical tongue 30 is a diameter slightly less than the diameter of groove 24, to permit the interconnection of panels 10, as shown in FIG. 3**.

Figure 5:
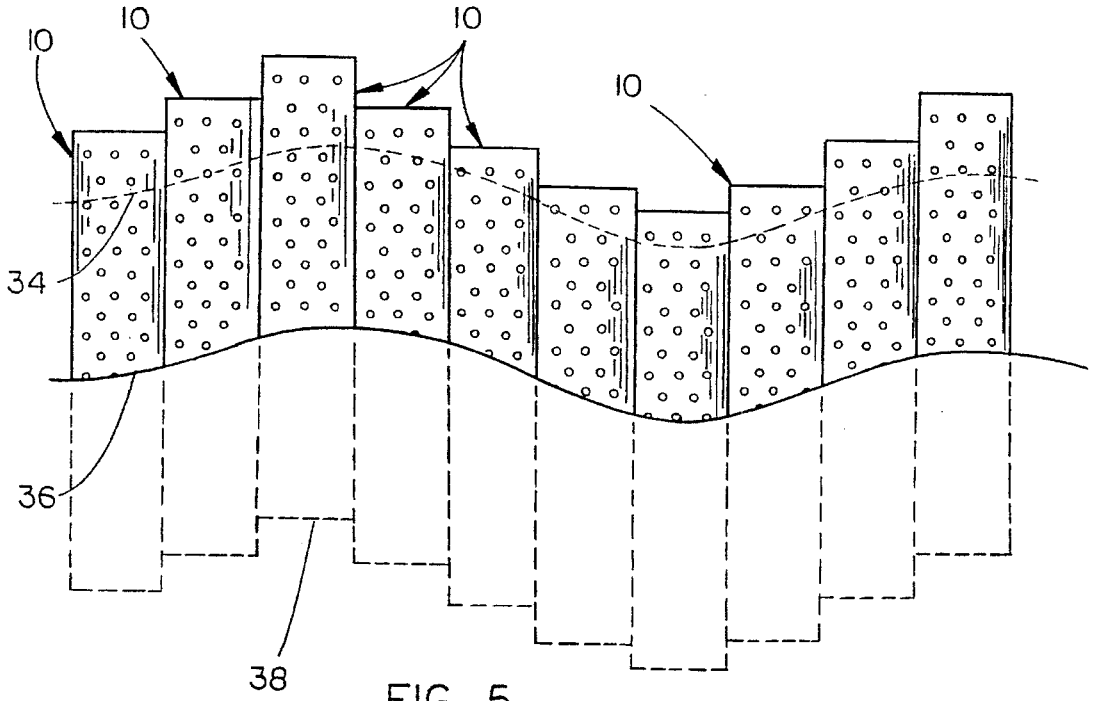
FIG. 5 is a front elevational view of a retaining wall installed in rolling ground.

Because shoulders **26*a*, 26*b*, 32*a* and 32*b* are beveled, the tongue 30 of each panel 10 is pivotable within the groove 24 of the adjacent wall panel 10, with the abutting contact of adjacent shoulders 26*a* and 32*a*, or adjacent shoulders 26*b* and 32*b*, contact one another to prevent further pivotal movement. In addition, each tongue 30 within each groove 24 prevents the separation of connected panels, yet permits a curvilinear arrangement of the panels, in plan view, as shown in FIG. 3. Tongues 30 are also vertically slidable within grooves 24, to permit infinite vertical adjustment of panels 10 with respect to one another, as shown in FIG. 5. The level of the ground being retained by wall panels 10 is shown by dashed line 34 in FIG. 5, while the lower ground line 36 is shown spaced well below the upper ends of panels 10. Hidden lines 38 show that approximately one-half of the height of each panel 10 is embedded into the ground at the level of the lower ground line. Depending upon the material used for each panel 10, the structural integrity of each panel is enhanced by the interconnection of the panels, as well as any curvilinear connection, such as that shown in FIG. 3**, providing greater stability to the overall wall.

Figure 6:
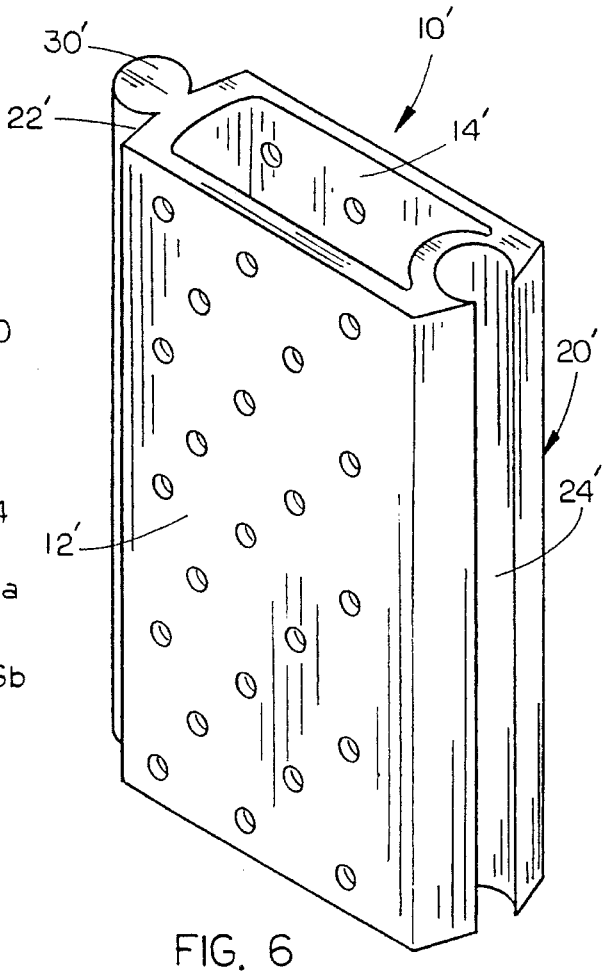
FIG. 6 is a perspective view of a second embodiment of a retaining wall panel.

A second embodiment of a wall panel is designated generally at 10' in FIG. 6, and has the same overall exterior shape with a perforated forward wall 12', perforated rearward wall 14', a first end wall 20' with a vertical groove 24' therein, and a second vertical end wall 22' with a vertical tongue 30' affixed therealong. The main difference between panel 10' of FIG. 6 and the first embodiment of panel 10 shown in FIG. 4 is that panel 10' is formed of a rigid plastic material which permits the entire panel to be hollow, with a space between forward and rearward walls 12' and 14'. This configuration obviously permits a reduction in the work overall weight of each panel 10'.

Whereas the invention has been shown and described in connection with the preferred embodiments thereof, it will be understood that many modifications, substitutions and additions may be made which are within the intended broad scope of the appended claims.

I claim:

1. A panel for an erosion control wall, comprising:

a panel having a forward face, opposing rearward face, an upper end, a lower end, first end wall and opposing second end wall;

a plurality of perforations extending from the forward face to the rearward face having a diameter permitting the passage of water therethrough but preventing the passage of soil therethrough;

a tongue projecting outwardly from the second end wall and extending from the upper to the lower ends; and a groove formed in the first end wall extending from the upper to the lower ends;

said tongue having a cross-sectional shape corresponding to the cross-sectional shape of the groove.

2. The panel of claim 1, wherein said tongue and groove have a generally circular cross-sectional shape.

3. The panel of claim 1, wherein said panel is hollow.

4. The panel of claim 1, wherein said tongue is generally centrally located between the forward and rearward faces forming vertical forward and rearward shoulders extending from the tongue to the forward and rearward faces, respectively, said forward and rearward shoulders being beveled towards the second end from the tongue to the forward and rearward faces.

5. The panel of claim 4, wherein said groove is generally centrally located between the forward and rearward faces forming vertical forward and rearward shoulders extending from the groove to the forward and rearward faces, respectively, said first end forward and rearward shoulders being beveled towards the second end from the groove to the forward and rearward faces.

6. The panel of claim 1, further comprising a second panel identical to the first panel with a tongue projecting from a second end and a groove formed in the first end, connected to said first panel with said second panel tongue slidably and pivotably engaged within said first panel groove.

7. The panel of claim 6, wherein said panel tongues and grooves have a shaped permitting pivotal movement about a vertical axis, but preventing lateral separation of the tongue from the groove.

8. The panel of claim 7, wherein said tongue and groove have a generally circular cross-section.

9. An adjustable erosion control wall, comprising:

a first vertical panel having a first vertical side edge;

a second vertical panel having a first vertical side edge; and means for pivotally connecting said panels along the first side edges for vertical slidable movement and pivotal movement about said first edges and for preventing horizontal separation of the panels at the first edges thereof.

10. The erosion control wall of claim 9, wherein:

said first panel includes a forward face, opposing rearward face, upper end, lower end, first end wall and opposing second end wall;

a tongue projecting outwardly from the second end wall and extending from the upper to the lower ends thereof;

a groove formed in the first end wall extending from the upper to the lower ends;

said tongues having a cross-sectional shape corresponding to said grooves;

said second panel being identical to the first panel and having a tongue slidably and pivotally connected with the first panel groove.

* * * * *